United States Patent [19]

Zaplotnik

[11] 4,327,889

[45] May 4, 1982

[54] READING-APPARATUS

[76] Inventor: Josef Zaplotnik, Wallisellenstrasse 21, CH-8600 Dübendorf, Switzerland

[21] Appl. No.: 134,805

[22] Filed: Mar. 28, 1980

[30] Foreign Application Priority Data

Apr. 6, 1979 [CH] Switzerland ..... 3231/79

[51] Int. Cl.[3] ..... A47B 19/00; A47B 97/04

[52] U.S. Cl. ..... 248/441 B; 248/448

[58] Field of Search ..... 248/441 B, 442.2, 448

[56] References Cited

U.S. PATENT DOCUMENTS 3,140,558 7/1964 Cassidy ..... 248/448

4,140,296 2/1979 Guillen ..... 248/441 B

FOREIGN PATENT DOCUMENTS 553554 6/1932 Fed. Rep. of Germany ... 248/441 B

*Primary Examiner*—Patrick D. Lawson

*Attorney, Agent, or Firm*—Pollock, Vande Sande & Priddy

[57] ABSTRACT

An adjustable support panel assembly for positioning a book, brochure, newspaper or the like in a predetermined orientation, wherein a support panel includes a pair of laterally adjustable frame members, with each frame member supporting a pair of relatively moveable clamping members. A first clamping member of each pair is fixedly attached to one of the frame members and a second clamping member is attached to a pusher shaft slidably received in a support rod also attached to the frame member, with a spring member biasing the second clamping member toward the first clamping member to fixedly clamp a book, brochure, newspaper or the like in a predetermined orientation therebetween.

16 Claims, 4 Drawing Figures

Fig.1
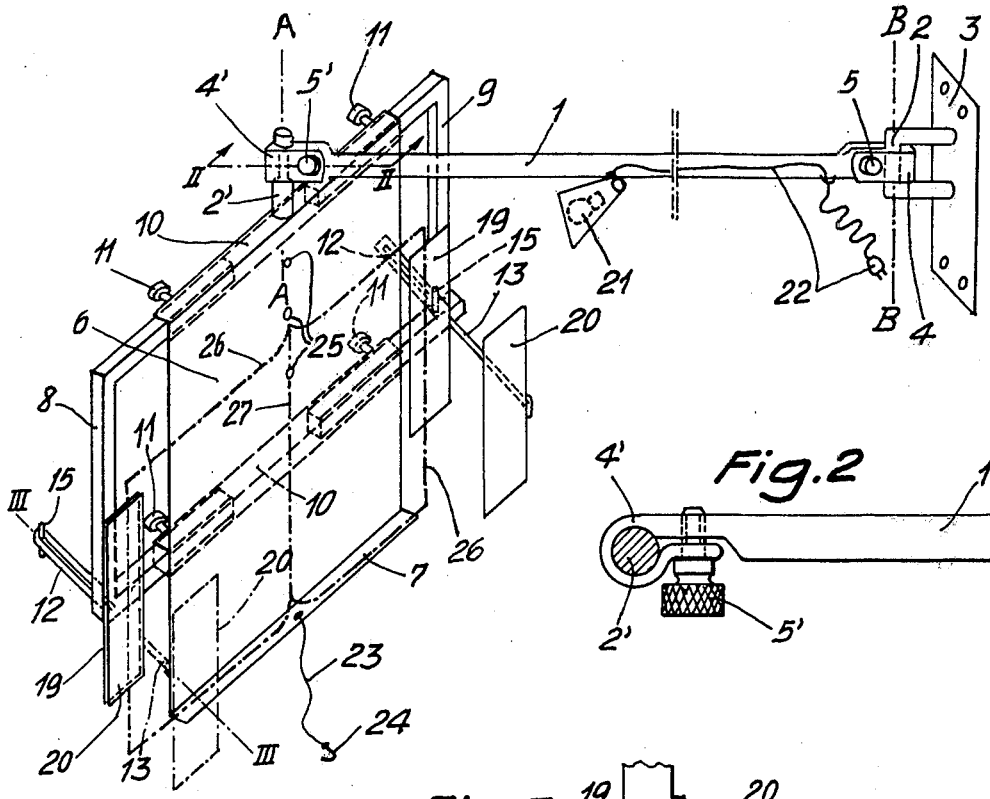
Fig.2
Fig.3
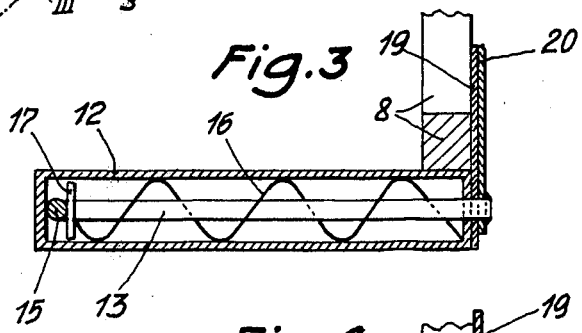
Fig.4
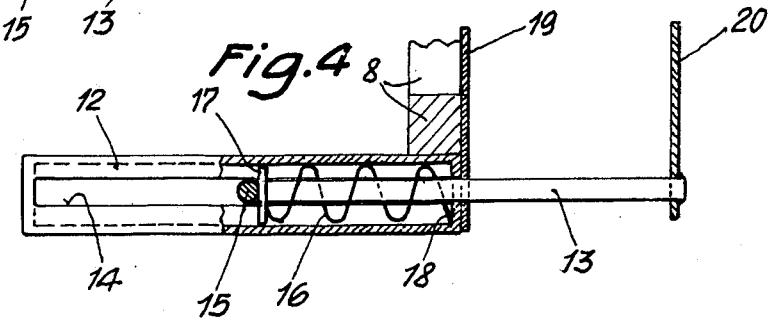

READING-APPARATUS

This invention is a reading-apparatus with an adjustable panel on which a book can be fixed. The panel is connected via a flexible support to a fastening. Some existing reading apparatus assemblies have a movable rod and an adjustable panel. Others have a flexible rod and an adjustable panel. But all these known apparatus assemblies are restricted in their movements and adjustments. Also existing assemblies have proven less than satisfactory in the manner a book is fastened on the panels, because the panels ae usually not suitable for all sizes of books. In comparison the adjustable panel reading-apparatus constituting the present invention, allows an unlimited adjustment of the panel and is suitable for all sizes of books, which nowadays on the market.

SUMMARY OF THE INVENTION

According to the present invention, unlimited adjustment of the panel is obtained by its linkage, which linkage consists of a swivelling rod positioned around a vertical axis and a swivelling connection of the panel. The suitability for all books is obtained by two special frames which can be drawn out and pushed into a guide of the panel, at its right and left side. The panel of the reading-apparatus forming the present invention is always rectangularly adjustable relative to the person who is reading. Also every lateral adjustment is possible by selective movement of the swivelling rod.

The adjustable panel reading-apparatus can be fixed to every wall, and is very suitable for reading in bed, in the livingroom or in the office. It is also a very good help for sick and handicapped persons. The reading-apparatus allows a very relaxed bearing on posture while reading, thereby allowing a reader to reduce stress on his eyes.

BRIEF DESCRIPTION OF THE DRAWINGS

The drawings show a preferred embodiment of the present invention wherein

FIG. 1 shows a three-dimensional representation of a preferred embodiment of the reading apparatus fixed to a wall;

FIG. 2 shows a section through a flexible joint portion employed in the preferred embodiment taken along line II—II of FIG. 1, but in a larger scale;

FIG. 3 shows a section through a clamp employed in the preferred embodiment taken along line III—III of FIG. 1, but in a larger scale wherein the clamp is shown in a closed position; and FIG. 4 shows the clamp of FIG. 3, but in open position.

DETAILED DESCRIPTION OF THE PREFERRED EMBODIMENT

A horizontal bearing rod 1 is at one end connected via a clamp 4 to a console 3. The bolt of an adjusting screw 5 connects clamp 4 with being rod 1 and allows a vertical movement of the rod, while the vertical axis 2 of the console allows a horizontal movement of the rod. The console can be mounted to the wall. The friction of the adjusting screw 5 against clamp 4 prevents an unallowable swivelling of the rod 1. The other end of the bearing rod is also connected with a clamp 4' which is attached to a vertical build-up axis 2' of a panel assembly 6. The panel 6 can move around its vertical axis 2' and around the bolt of an adjusting screw 5' extending between and connecting rod 1 to clamp 4. A strip 7, which keeps the book at its lower side forms an integral part of the panel 6. A pair of frames (8,9) can slide in a guide portion 10 of the panel 6 and can be fixed in preselected positions via screws 11 after adjustment. The immovable parts of the clamps 19 are mounted at the lower corners of the frames. The movable parts of the clamps 20 move in slits 14, which are milled in a pair of hollow rods 12. A pair of pushers 13, which carry the movable clamps 20 extend into hollow rods 12 and are protected from turning within the hollow rods by small cross pins 15 which extend into the slits 14 and a separate spring 16 is positioned within each hollow rod 12 and is clamped between a small disk 17 and the front wall 18 of a respective rod 12.

The immovable parts 19 of the clamps are each arranged in a plane with the panel 6, so, that a book, when laying on panel 6, also is laying on the immovable clamps 19, and can be kept in position by the movable clamps 20, which press by spring force.

To clamp a book 26 on the reading-apparatus, one has only to push the pushers forward by means of the cross-pins into the open position as shown in FIG. 4.

Before clamping the book 26, the frames 8,9 have to be adjusted to the width of the book. A spot light 21, which is conveniently mounted on the bearing rod 1, lights the book, which is clamped on the panel 6. The lamp can be turned on by putting the plug of the electric cable 22 into a socket. An elastic wire 23, connected with one end in a hole of the strip 7, is put over the middle of the book, to keep the middle of the book fixed to the panel 6 and can be attached to panel 6 via a hook 24 at its other end which can be extended into a hole 25 of the panel.

Additionally the side parts of the book have to be clamped between the clamps 19 and 20. By means of the possibility of turning the panel 6 round axis A—A and the possibility of swivelling bearing rod 1 round axis B—B, panel 6 can be brought into a most favourable position for the reader. It is not necessary to detach the elastic wire 23, when turning over the leaves of the book. It is enough to open the clamps 19.20, one after the other. Large newspapers should be fold to the right size, and they can be kept in position with only the clamps 19.20.

The reading-apparatus comprising the present invention is especially designed for the reading of small, large, stable and unstable materials, such as books, newspapers etc. and by means of the manifold adjustments of the panel assembly it is possible to arrange the reading material in a very comfortable way.

The apparatus consists mainly of following parts. The panel assembly 6, including sidewardly extensible frames (8.9) which carry clamps (19.20). The panel (6) is connected with a bearing rod (1), which in turn is connected with a console (3). Special clamps (4 and 4') with adjusting screws (5 and 5') allow swivelling movement of the panel and bearing rod in both the horizontal and vertical directions.

(The clamps (19 and 20) are plates, from which the immovable part (19) is fixed to the frame (8) and the movable part (20) is extensible and can be pressed against the immovable part (19) by spring force.

I claim:

1. Device for reading, comprising a holding panel adjustably mounted on a support or on a pivotably supported beam of a mounting device and serving for the support of an object intended to be read or looked at, e.g. a book, crochure, newspaper, etc., characterized in that the holding panel having at its lower edge a supporting ledge is provided with frame parts with clamping devices, each of said clamping devices comprising a fixed clamping plate diposed in the plane of the holding panel and a moving clamping plate disposed parallel to said fixed clamping plate and adapted to be retracted against the force of a spring, said frame parts being laterally movable in and out along guides and being mounted on a pivoting support rod which, in turn, is mounted on a bracket to pivot around a vertical axis B—B, and is adapted to carry at its free end the holding panel mounted to pivot around a vertical axis A—A.

2. Device as claimed in claim 1, characterized in that the holding panel comprises an elastic wire fixedly mounted at its one end on the supporting ledge and provided at its other end with a hook, said elastic wire being adapted to be stretched upwardly along the bound edge of a book placed on the holding panel and to hooked by way of the hook in one of the holes of the holding panel.

3. Device as claimed in claim 1, characterized in that the pivot pin, which carries the holding panel, and the pivot, which carries the pivoting support rod are each pivotably supported in a clamp provided with tightening screws 5, 5'.

4. Device as claimed in claim 1, characterized in that the support rod carries a lamp directed toward the holding panel carrying the object being read, said lamp being adapted to be plugged in by way of a plug-in cable into the nearest socket.

5. An adjustable support panel assembly for clamping a book, brochure, newspaper or the like in a predetermined orientation, and comprising:

a support panel including at least one guide sleeve having an end portion slidably attached to a first frame member and having an opposite end portion slidably attached to a second frame member substantially laterally spaced from said first frame member;

first and second pairs of confronting clamping members, wherein each pair of confronting clamping members includes a first clamping member fixedly attached to a separate frame member;

biasing means extending between each frame member and a second clamping member for biasing said second clamping member toward a respective first clamping member to fixedly clamp a portion of said book, brochure, newspaper or the like in a predetermined orientation therebetween; and adjustable connection means extending between said support panel and a fixedly positioned support structure for allowing pivotal movement of said panel assembly relative to said support structure.

6. An adjustable support panel assembly according to claim 5, wherein said adjustable connection means comprises a support rod having an end portion pivotally attached to a support bracket and having an opposite end portion attached to a pivot pin member extending from said guide sleeve, with said support bracket attached to the fixedly positioned support structure.

7. An adjustable support panel assembly according to claim 6, wherein a first, substantially U-shaped clamp surrounds said support bracket and encloses an end portion of said support rod positioned adjacent thereto, with a fastening screw extending through aligned apertures formed through said substantially U-shaped clamp and said enclosed end portion of said support rod to pivotally attach said support rod to said support bracket.

8. An adjustable support panel assembly according to claim 7, wherein said support bracket extends in a substantially vertical direction and said fastening screw extends in a substantially horizontal direction, allowing said clamp and attached support rod to pivot about a vertical axis extending through said support bracket and allowing said support rod to pivot about a horizontal axis extending through said fastening screw.

9. An adjustable support panel assembly according to claim 6, wherein said opposite end portion of said support rod is of substantially U-shaped configuration and surrounds a portion of said pivot pin member, with a pair of aligned apertures extending through confronting portions of said U-shaped end portion and a fastening screw extending through said aligned apertures to selectively tighten said U-shaped end portion into engagement with said pivot pin member.

10. An adjustable support panel assembly according to claim 9, wherein said pivot pin member extends in a substantially vertical direction through said U-shaped end portion of said support rod.

11. An adjustable support panel assembly according to claim 5, wherein said guide sleeve extends along a vertically upper edge portion of said support panel, with a further guide sleeve is also being attached to an intermediate portion of said support panel, said further guide sleeve extending substantially parallel to said guide sleeve and having an end portion slidably attached to said first frame member and an opposite end portion slidably attached to said second frame member.

12. An adjustable support panel assembly according to claim 11, wherein said first and second frame members each extend in a substantially vertical direction.

with said guide sleeve and said further guide sleeve each extending in a substantially horizontal direction.

13. An adjustable support panel assembly according to claim 12, wherein each of said first and second frame members is of substantially U-shaped configuration and includes opposite end portions confronting one another, wherein said opposite end portions of each frame member extend into either said guide sleeve or said further guide sleeve, whereby said first and second frame members are relatively moveable toward or away from one another to align said frame members with opposite sides of the particular book, brochure, newspaper or the like supported on said panel assembly.

14. An adjustable support panel assembly according to claim 5, wherein said biasing means comprises a pair of hollow support rods with each support rod fixedly attached to a separate frame member and extending in a direction substantially perpendicular to a plane formed by said support panel;

said biasing means further comprises a pair of pusher shafts each having a first end portion slidably supported within one of said hollow support rods and each pusher shaft having a second, oppositely disposed end portion extending outwardly from a support rod and fixedly attached to one of said second clamping members;

said biasing means further comprises a separate helical spring member positioned within each hollow support rod and surrounding the first end portion of the pusher shaft extending therein, each helical spring having an end portion engaging an end wall of the hollow rod and having an opposite end portion engaging an end of said pusher shaft for biasing said pusher shaft into hollow rod to move said second clamping member toward a confronting first clamping member.

15. An adjustable support panel assembly according to claim 14, wherein each hollow support rod includes a slot formed through an outer surface and extending in a direction parallel to a longitudinal axis of said hollow support rod, and each pusher shaft has a pin member attached to said first end portion, wherein each pin member is positioned within a hollow support rod and extends through one of said slots to prevent said pusher shaft and said attached second clamping member from rotating relative to said hollow support rod.

16. An adjustable support panel assembly according to claim 5, wherein a wire formed of an elastomeric material has a first end portion fixedly attached to a vertically lowermost portion of said support panel, said elastomeric wire further includes a hook-shaped member attached to an opposite end portion and adaptable for engaging a hole formed in a vertically uppermost portion of said support panel for retaining in place a book, brochure, newspaper, or the like positioned adjacent the support panel.

* * * * *